US006877749B2

(12) United States Patent
Warmoth et al.

(10) Patent No.: US 6,877,749 B2
(45) Date of Patent: Apr. 12, 2005

(54) SEAL FOR USE WITH A MOVABLE ROD

(75) Inventors: Thomas B. Warmoth, Downers Grove, IL (US); Kevin L. Yost, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/305,052

(22) Filed: Nov. 25, 2002

(65) Prior Publication Data

US 2004/0100036 A1 May 27, 2004

(51) Int. Cl.[7] ..... B60T 11/236
(52) U.S. Cl. ..... 277/436; 277/634; 123/188.6
(58) Field of Search ..... 277/437–439, 277/436, 634, 635, 636, 502; 123/188.6

(56) References Cited

U.S. PATENT DOCUMENTS 4,325,558 A * 4/1982 Poggio ..... 277/502
4,834,037 A * 5/1989 Lafever ..... 123/188.6
5,079,921 A 1/1992 McCandless et al.
5,174,256 A * 12/1992 Binford ..... 123/188.6
5,553,869 A * 9/1996 Stamback ..... 277/502
5,558,056 A * 9/1996 Sakata ..... 123/188.6
5,775,284 A * 7/1998 Kirchner et al. ..... 123/188.6
6,209,504 B1 * 4/2001 Hegemier et al. ..... 123/188.6
6,244,235 B1 * 6/2001 Hegemier et al. ..... 123/188.6
6,270,082 B1 * 8/2001 Hegemier ..... 277/502
6,450,143 B1 * 9/2002 Hegemier et al. ..... 123/188.6
6,571,761 B1 * 6/2003 Leimer ..... 123/188.6
6,647,943 B2 * 11/2003 Leimer et al. ..... 123/190.17

* cited by examiner

*Primary Examiner*—William L. Miller
(74) *Attorney, Agent, or Firm*—Susan L. Lukasik; Dennis Kelly Sullivan; Jeffrey P. Calfa

(57) ABSTRACT

An apparatus for and method of providing a seal (300) for a movable rod (111) is described. The seal includes a flexible material (303) and a rigid seat (305) that may be utilized as a spring seat. The flexible material (303) has an opening with annular grooves and/or bumps (301) that provide a seal with the rod (111) when it moves axially and/or non-axially, for example, within a cylinder (109) in which the rod (111) and seal (300) are disposed.

20 Claims, 4 Drawing Sheets

SEAL FOR USE WITH A MOVABLE ROD

FIELD OF THE INVENTION

This invention relates to seals, including but not limited to seals for movable rods utilized in combustion engines.

BACKGROUND OF THE INVENTION

Internal combustion engines, such as diesel engines, are known to utilize exhaust back pressure control systems to improve engine warm-up, particularly in cold environments. A diagram of such a system is shown in FIG. 1. A turbocharger comprising a compressor 101 operating in conjunction with a turbine 103 via a common shaft has an exhaust valve 105 that rotates between open and closed positions as directed by a pivot shaft rod 107. When a cylinder 109 is pressurized, a piston within the cylinder 109 moves a rod 111 that is attached to a ball joint linkage 113 that is in turn attached to a crank 115. The axial movement of the rod 111 is converted to rotational movement of the crank 115 by the ball joint linkage 113, resulting in rotation of the pivot shaft rod 107, which opens and closes the valve 105. By closing the valve 105, the engine is forced to work harder against the exhaust pressure build up, thereby warming up faster.

A diagram illustrating a cross-sectional view of the cylinder 109 is shown in FIG. 2. A single-acting hydraulic cylinder 109 with a spring return is illustrated. A hydraulically operated piston 201 compresses a spring 203 and moves the rod 111 to move the rod 111 in order to open and close the valve 105 of FIG. 1. One or more washers 205 are utilized to provide a rudimentary seal between the rod 111 and the cylinder 109. Because no rod guide bearing is utilized, the rod 111 moves axially, radially, and/or in other directions within the cylinder. With age and repeated use of the piston 201, the washer 205 eventually wears out, and oil leakage may result.

Accordingly, there is a need for a seal that does not leak when the seal is utilized in conjunction with a rod that moves axially, radially, and/or in other directions within the cylinder.

SUMMARY OF THE INVENTION

An apparatus for providing a seal includes a cup having a hollow interior capable of receiving a rod and having a flexible sleeve including an opening with a plurality of at least one of annular grooves and annular bumps capable of providing a seal with the rod when the rod moves in a non-axial direction with respect to the cup. A rigid seat is disposed on an exterior surface of the cup and is capable of receiving a spring.

DESCRIPTION OF A PREFERRED EMBODIMENT

The following describes an apparatus for and method of providing a seal for a movable rod. The seal includes a flexible material and a rigid seat that may be utilized as a spring seat. The flexible material has an opening with annular grooves and/or bumps that provide a seal with the rod when it moves axially and/or non-axially, for example, within a cylinder in which the rod and seal are disposed.

Figure 3:
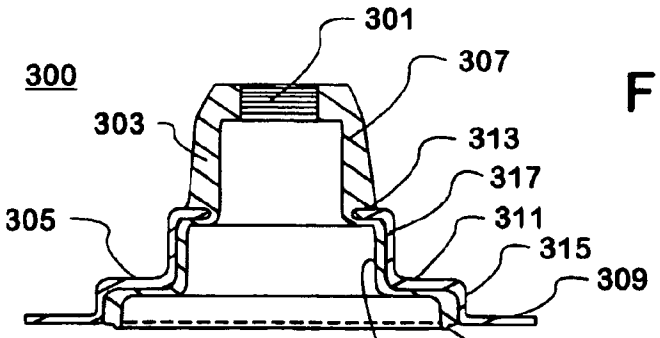
FIG. 3 is a cross-sectional view of a seal in accordance with the invention.

A cross-sectional view of a seal 300 through the seal's diameter is shown in FIG. 3. The seal 300 is comprised of a flexible material 303 and a rigid seat 305. The flexible material 303 is generally cup-shaped with steps that cover at least part of an inner surface of the rigid seat 305. The flexible material 303 is joined to the rigid seat 305 by applying a chemical to the rigid seat 305. The chemical, which may be a chemical bonding agent, e.g., Chemlock™, forms a bond with the flexible material 303. The rigid seat 305 is inserted to a mold, the chemical is added, and the flexible material 303 is injected into the mold. After the molding process, the rigid seat 305 is permanently bonded to the flexible material 303. The flexible material 303 may be rubber or any type of soft, conformable material that may be utilized for sealing, and the rigid seat 305 may be steel or any type of rigid material.

As shown at the top of FIG. 3, a plurality of annular grooves and/or bumps 301 are disposed at an opening of the seal 300 in a flexible sleeve 307 of the seal 300. The annular grooves and/or bumps 301 are substantially parallel and form a seal with the rod 111. The annular grooves and/or bumps 301 advantageously have an interference fit to the rod 111. Alternatively, a helical groove and bump may be utilized. The sealing engagement between the annular grooves and/or bumps 301 of the flexible sleeve 307 and the rod 111 provides a multi-point seal with the capability of maintaining a positive sump (crankcase) pressure as the rod 111 moves axially and/or non-axially with respect to the cylinder 109 and/or seal 300. Non-axial movement includes movement in any direction(s) other than in the axial direction. For example, non-axial movement may include at least partially radial movement, rotational movement, movement between any two points along the sides of the cylinder, nutating movement, movement along any plane, and/or any combination thereof.

The flexible sleeve 307 is a hollow cone-like projection that extends away from the rigid seat 305 and is flexible to provide the capability of the rod 111 to move axially and/or non-axially with respect to the rigid seat 305. The rigid seat 305 is formed with a base 309, two landings 311 and 313, and two risers 315 and 317 between the base 309 and landings 311 and 313. The rigid seat 305 is shown as a series of progressively smaller concentric steps as the seat approaches the flexible sleeve 307. The base 309 and first riser 315 form a spring seat that receives the spring 203. By integrating the spring seat with the seal 300, a separate spring seat need not be utilized. The risers 315 and 317 and landings 311 and 313 limit the amount of non-axial travel of the seal 300 with respect to the cylinder 109. The risers 315 and 317 and the flexible sleeve 307 are appropriately sized such that the piston 201 does not contact the seal 300 when the spring 203 is fully compressed.

The second landing 313 is optionally partially disposed inside the wall of the flexible material 303. When the flexible material surrounds the innermost edge of this landing 313, the amount of overlap for the chemical bond between the rigid seat 305 and the flexible material 303 is maximized.

As shown in FIG. 3, the flexible material 303 extends from the flexible sleeve 307 as a series of steps and risers 319 that cover the inner surface of the landings 311 and 313 and risers 315 and 317 of the rigid seat 305. The flexible material 303 continues from the steps and risers 319 and extends away from the base 309 of the rigid seat 309 to form an optional lip 321 that provides a seal with the inner surface of the housing of the cylinder 109 near the rod guide 607 as shown in FIG. 6.

Figure 4:
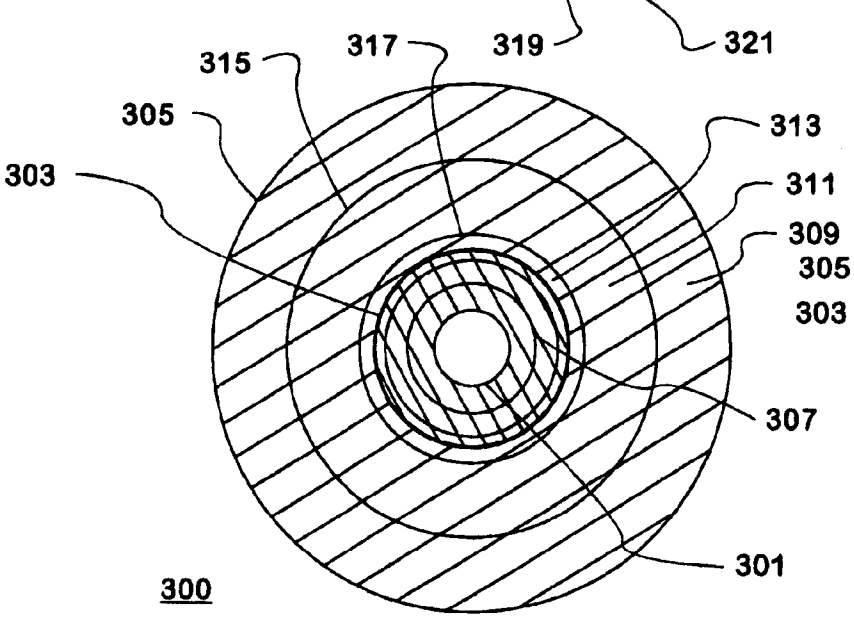
FIG. 4 is a top view of the seal in accordance with the invention.

A top view of the seal is shown in FIG. 4. The top view shows a plurality of concentric circles that form the various features of the seal, such as the outer diameters of the steps of the rigid seat 305 and the general shape of the flexible material 303. The annular grooves and/or bumps 301 formed at the opening of the flexible sleeve 307 outline the cavity in which the rod 111 is inserted through the seal 300. The base 309, landings 311 and 313, and risers 315 and 317 of the rigid seat 305 form a series of concentric steps. The widest coil of the spring 203 rests on the base 309 against the first riser 315. Although the risers 315 and 317 are shown to be substantially perpendicular to the base 309 and landings 311 and 313, the risers 315 and 317 may be set off at an angle other than 90 degrees.

Figure 5:
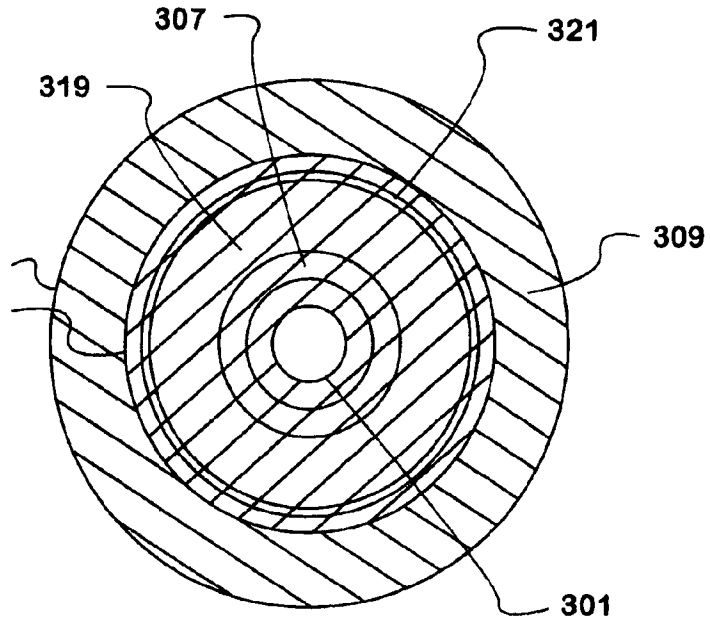
FIG. 5 is a bottom view of the seal in accordance with the invention.

A bottom view of the seal is shown in FIG. 5. The flexible material 303 extends from the annular grooves and/or bumps 301 to the base 309 of the rigid seat 305. The inner diameter of the flexible sleeve 307 may be angled away from the annular grooves and/or bumps 301 at the same angle as the outer diameter of the flexible sleeve 307, or the two angles may be different. The optional lip 321 is formed as a ring in the flexible material 303 near the inner periphery of the base 309. The lip 321 may be circular, as shown, or may take on other shapes. Although the flexible material 319 formed on the inner surface of the rigid seat 305 is shown as having substantially uniform thickness, varying thickness of the flexible material 319 may also be utilized. Alternatively, the flexible material 303 may end at the landing 313 and a second application of flexible material or other material may be disposed on the bottom of the rigid seat 305 to form the lip or seal 321, although such an implementation may not be as advantageous as utilizing a single continuously molded application of flexible material such as shown in FIG. 3.

Figure 1:
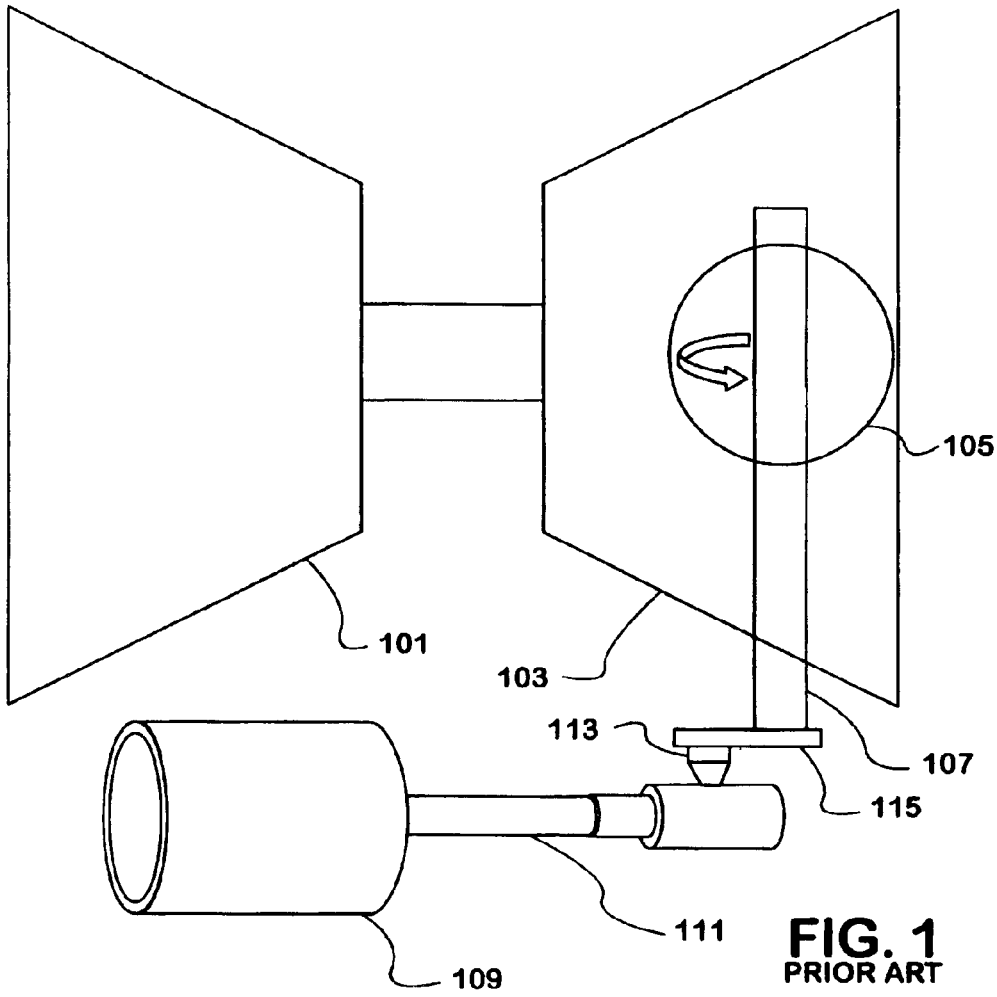
FIG. 1 PRIOR ART
FIG. 1 is a diagram of an exhaust back pressure control system.
Figure 2:
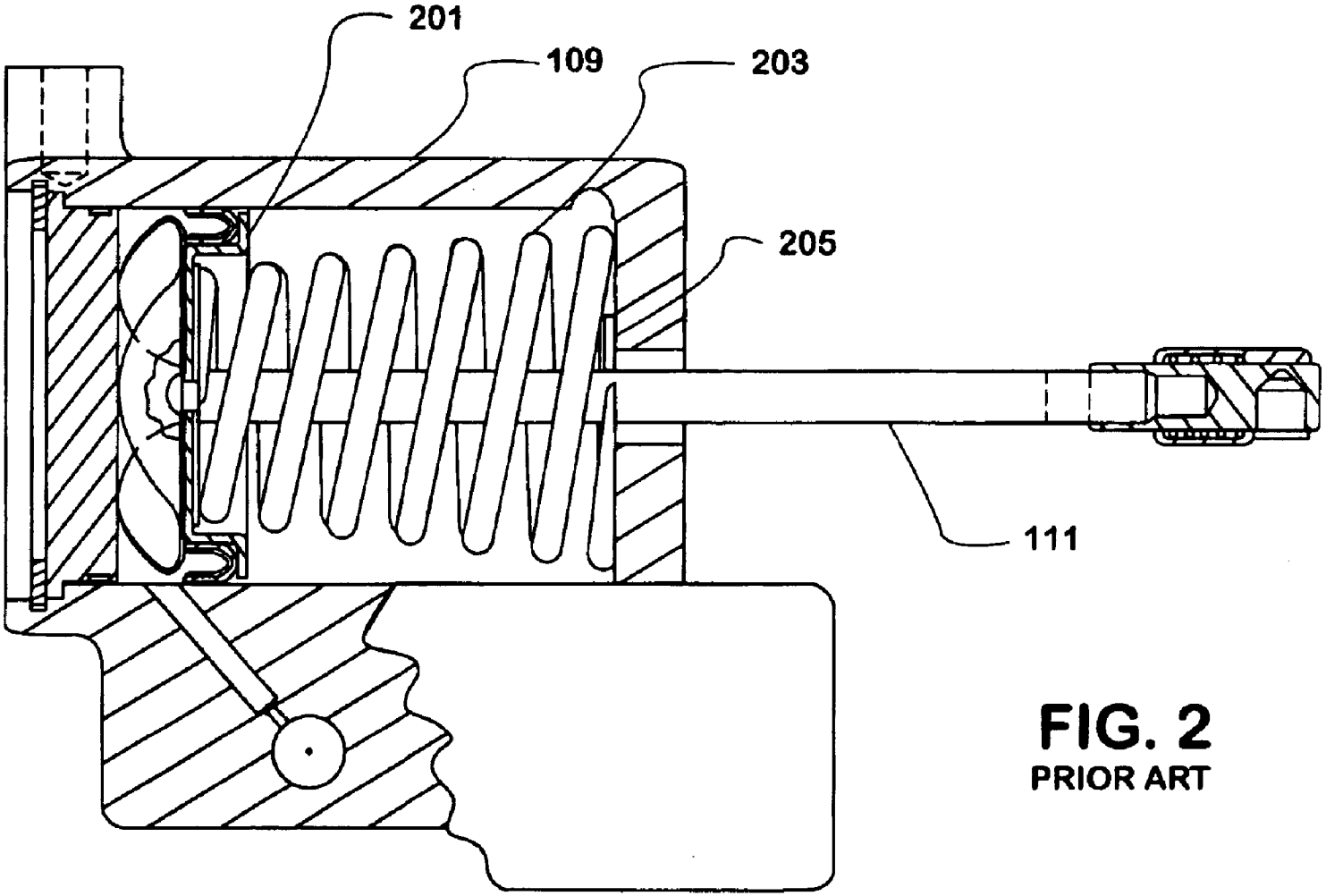
FIG. 2 PRIOR ART
FIG. 2 is a cross-sectional view of a cylinder utilized in an exhaust back pressure control system.
Figure 6:
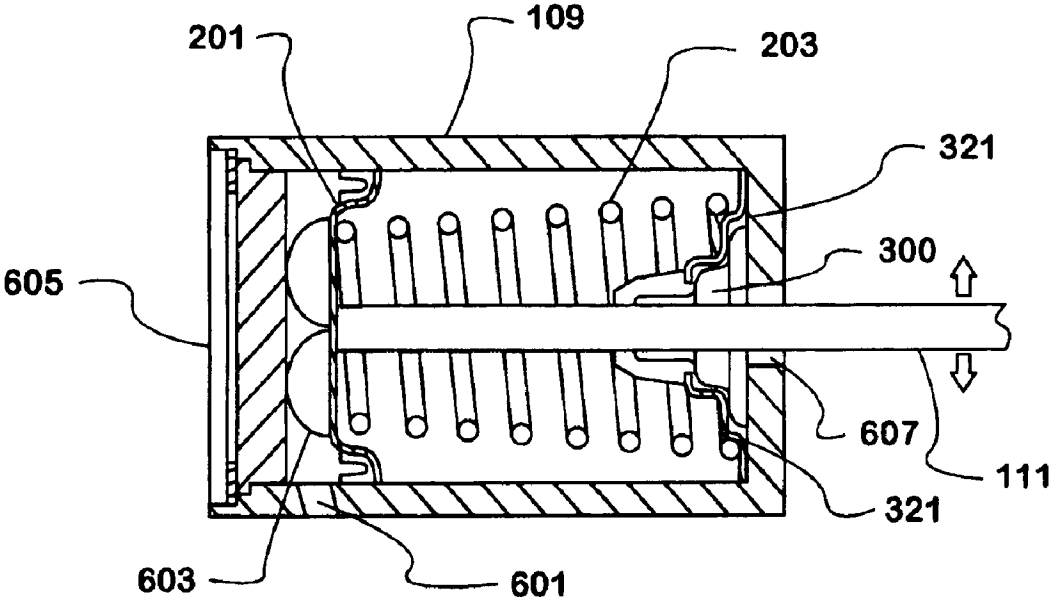
FIG. 6 is a cross-sectional view of a cylinder with the seal installed in accordance with the invention.

A cross-sectional view of a cylinder with the seal 300 installed is shown in FIG. 6. The cylinder 109 is shown as a single-acting hydraulic cylinder with a spring return. The housing provided by the cylinder 109, which may be part of a turbo pedestal, shows the rod 111 extending substantially through the center of the cylinder 109 until the rod 111 meets with the piston 201. A spacer 603 separates the piston 201 from an end cap 605 of the cylinder 109 to prevent hydraulic lock. In this example, a hydraulic fluid, such as engine oil, is forced into the cylinder 109 via an aperture 601 in the cylinder 109. When the hydraulic pressure increases, the piston 201 moves from the end cap 605 toward the seal 300, thereby compressing the spring 203 into the rigid seat 305 of the seal 300. The cylinder 109 has an aperture 607 that operates as a rod guide near the seal 300 to allow the rod 111 to move axially and/or non-axially with respect to the cylinder 109 and/or seal 300. The hydraulic pressure is relatively low, on the order of 50 to 100 psi. A washer 205, such as shown in FIG. 2, may optionally be utilized between the seal 300 and the rod guide 607.

Figure 7:
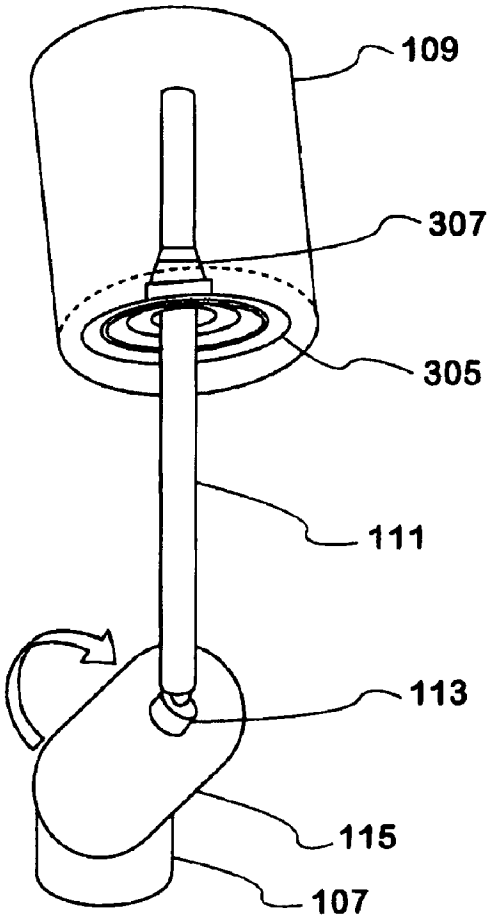
FIG. 7 is a perspective view of a rod with the seal installed in the cylinder in accordance with the invention.

A perspective view of a rod with the seal installed in the cylinder is shown in FIG. 7. The cylinder may be used, for example, in an exhaust back pressure control system, such as the one shown in U.S. Pat. No. 5,079,921 titled "Exhaust Back Pressure Control System" by McCandless et al., the contents of which patent are incorporated in their entirety herein by reference. FIG. 7 shows a view of the armature that is utilized to open and close the valve 105 and shows how the platform 115 is rotated by the rod 111 to move the beam 107. The resultant radial motion of the rod 111 with respect to the cylinder 109 is also illustrated. The flexible sleeve 307 flexes to accommodate the radial motion of the rod 111, while the annular grooves and/or bumps 301 (not shown) at the opening of the flexible sleeve 307 maintain a seal with the rod 111.

The top and bottom views are arbitrarily named views. The seal may be utilized in any orientation. Although the various parts of the seal are shown as circular, the seal may be shaped differently, such as with rectangles, triangles, freeform, or a combination thereof. Although the seal is shown in the environment of an exhaust back pressure cylinder, the seal may be utilized in other environments where a seal for a movable rod is desired.

The present invention provides a multi-point seal that flexes with a moving rod disposed within the seal without restricting the required movement of the rod. The seal has annular grooves and/or bumps within a flexible sleeve that flexes with the moving rod while providing sealing engagement with the rod that may move axially and/or non-axially. The seal has a rigid seat that may be utilized as a spring seat. The seal may optionally have a sealing bump or lip that provides a seal with a housing in which the seal is disposed. The seal provides a pressure seal that is successful during temperature extremes that an engine may be exposed to during operation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a cup having a hollow interior capable of receiving a rod and having a flexible sleeve including an opening with a plurality of at least one of annular grooves and annular bumps capable of providing a seal with the rod when the rod moves in a non-axial direction with respect to the cup;

a rigid seat disposed on an exterior surface of the cup and capable of receiving a spring;

wherein a portion of the flexible sleeve including the opening extends axially beyond the rigid seat, such that the sleeve is capable of flexing in a non-axial direction when the rod moves.

2. The apparatus of claim 1, wherein the cup further comprises a lip that extends away from the rigid seat, wherein the lip is capable of providing a seal with a housing when the cup is disposed in the housing.

3. The apparatus of claim 1, wherein a raised lip forms a ring at an edge of the cup opposite to the opening.

4. The apparatus of claim 1, wherein the cup is comprised of concentric steps formed with a cone.

5. The apparatus of claim 4, wherein the rigid seat is comprised of concentric steps disposed on the concentric steps of the cup.

6. The apparatus of claim 1, wherein at least a part of the rigid seat is disposed inside a wall of the cup.

7. The apparatus of claim 1, wherein the plurality of at least one of annular grooves and annular bumps is further capable of providing a seal when the rod moves in an axial direction with respect to the cup.

8. The apparatus of claim 1, wherein the cup is comprised of rubber.

9. The apparatus of claim 1, wherein the rigid seat is comprised of steel.

10. The apparatus of claim 1, wherein the apparatus is utilized in a cylinder housing a piston that operates an exhaust back pressure valve.

11. The apparatus of claim 1, wherein the non-axial direction has at least a partial radial component.

12. A seal comprising:

a hollow cup including:

a first step having a first outer diameter;

a second step having a second outer diameter that is smaller than the first outer diameter;

a flexible sleeve having an opening with a plurality of at least one of annular grooves and annular bumps capable of providing a sealing engagement with a rod when the rod moves in a non-axial direction;

wherein the second step is disposed between the first step and the flexible sleeve;

a rigid seat including at least a base and first riser, arranged and constructed to provide a seat for a spring, wherein the rigid seat is disposed at least in part on an exterior surface of the first step;

wherein a portion of the flexible sleeve including the opening extends axially beyond the rigid seat, such that the sleeve is capable of flexing in a non-axial direction when the rod moves.

13. The seal of claim 12, wherein the cup further comprises a lip that extends in a direction away from the first hollow step and the rigid seat, wherein the lip is capable of providing a sealing engagement with a housing when the cup is disposed in the housing.

14. The seal of claim 12, wherein at least a part of the rigid seat is disposed inside a wall of the cup.

15. The seal of claim 12, wherein the non-axial direction has at least a partial radial component.

16. The seal of claim 12, wherein the plurality of at least one of annular grooves and annular bumps is further capable of providing a sealing engagement when the rod moves in an axial direction with respect to the cup.

17. The seal of claim 12, wherein the cup is comprised of rubber.

18. The seal of claim 12, wherein the rigid seat is comprised of steel.

19. The seal of claim 12, wherein the seal is utilized in a cylinder housing a piston that operates an exhaust back pressure valve.

20. An apparatus comprising:

a hollow cup capable of receiving a rod and having a flexible sleeve including an opening with a plurality of at least one of annular grooves and annular bumps capable of providing a seal with the rod when the rod moves in a non-axial direction with respect to the cup;

a rigid seat disposed on an exterior surface of the hollow cup and capable of receiving a spring, wherein the flexible sleeve including the opening extends axially beyond the rigid seat and is capable of flexing in a non-axial direction when the rod moves.

* * * * *